United States Patent [19]

Roberge et al.

[11] 4,393,157

[45] Jul. 12, 1983

[54] VARIABLE INDUCTOR

[75] Inventors: Gerald Roberge, Repentigny; André Doyon, Boucherville, both of Canada

[73] Assignee: Hydro Québec, Montreal, Canada

[21] Appl. No.: 966,555

[22] Filed: Dec. 5, 1978

[30] Foreign Application Priority Data

Oct. 20, 1978 [CA] Canada ..... 313821

[51] Int. Cl.[3] ..... H01F 17/06

[52] U.S. Cl. ..... 323/355

[58] Field of Search ..... 323/48, 56, 60, 76, 323/89 C, 124, 127, 205, 206, 355; 336/155, 160, 184, 214, 215

[56] References Cited

U.S. PATENT DOCUMENTS

| | | | |
|---|---|---|---|
| 1,788,152 | 1/1931 | Dowling | 323/76 X |
| 2,445,857 | 7/1948 | McCreary | 323/89 C |
| 3,188,456 | 6/1965 | King, Jr. et al. | 336/155 X |
| 3,403,323 | 9/1968 | Wanlass | 323/56 |
| 3,582,829 | 6/1971 | Wanlass | 323/56 X |
| 3,757,201 | 9/1973 | Cornwell | 336/215 X |

*Primary Examiner*—William M. Shoop

*Attorney, Agent, or Firm*—Raymond A. Robic; Arthur Schwartz

[57] ABSTRACT

The present invention relates to a variable inductor comprising a first closed magnetic circuit, formed of an anisotropic material, through which flows an alternative magnetic field, and a second closed magnetic circuit, also formed by an anisotropic material, through which circulates an adjustable direct current magnetic field. The first and second magnetic circuits are so disposed with respect to one another as to define at least two common magnetic spaces wherein the respective alternative and direct magnetic fields are orthogonally superimposed to orient the magnetic dipoles in the common spaces according to a direction predetermined by the intensity of the direct current magnetic field of the second circuit and thus to control the permeability of the first magnetic circuit to the alternative field. Arrangements for application of the variable inductance to monophase and three-phase circuits are proposed, which inductance may then operate in self-control with or without an inverse control.

20 Claims, 25 Drawing Figures

Fig. 20a
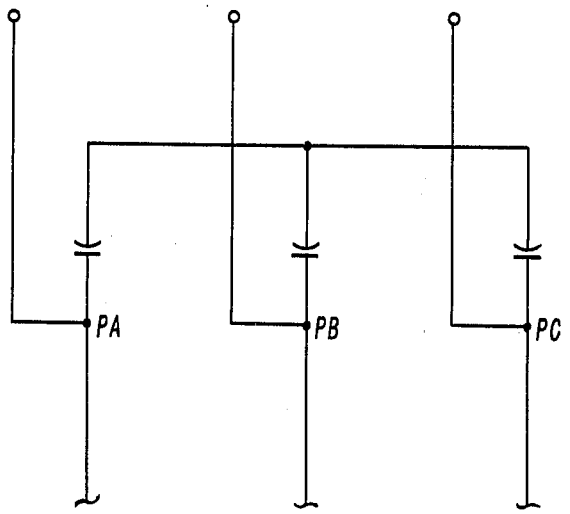
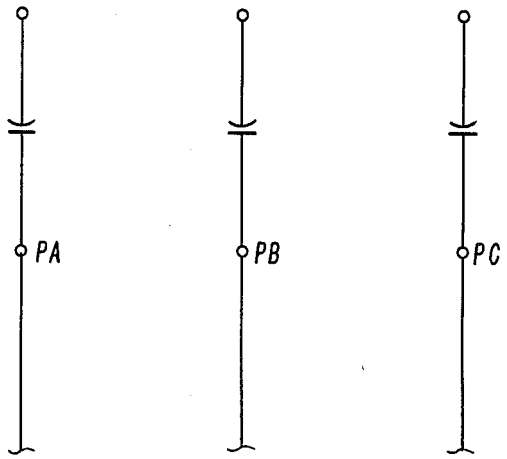
Fig. 20b

VARIABLE INDUCTOR

The present invention generally relates to a variable inductor and more particularly concerns an inductor the effective permeability of which is controlled by a closed magnetic circuit through which flows an adjustable and constant current magnetic flux.

At the present time, there exist several arrangements of devices able to perform as variable inductors by advocating a control of the permeability or the reluctance of the material forming the inductor through a longitudinal superposition of either alternative or constant magnetic flux. Such devices are for example described U.S. Pat. No. 1,788,152 delivered in 193 to Dowling; in U.S. Pat. No. 2,844,804 to Roe, July 22, 1958; in U.S. Pat. No. 2,976,478 to Aske, Mar. 21, 1961; and in U.S. Pat. No. 3,735,305 delivered to Sinnott et al on May 22, 1973. Additionally, U.S. Pat. No. 3,757,201 granted to Cornwe on Sept. 4, 1973 describes an apparatus useful in regulating a voltage, a current or a load, on the secondary side, by mean of a variable magnetic coupling which effects greatly the power coefficient of the inductor. In that patent, the permeability of the magnetic circuit is varied by means of a constant flux, adjustable in a direction normal to that of an alternative flux, but a substantial increase in the exciting current and in the leakage flux of the magnetic circuit is encountered. However, those known devices have major inherent drawbacks due to the fact that most of them operate at their saturation level and present a considerable distortion of the current wave caused by the harmonics generated in the magnetic circuits and therefore posse a low power coefficient.

A prime object of the present invention resides in avoiding the disadvantages mentioned above, in connection with the known devices, and is directed to an inductor having a low harmonic content ratio due to an appropriate control of its permeability or reluctance.

More specifically, the present invention is directed to a variable inductor which comprises a first closed magnetic circuit, constituted of an anisotropic material through which circulates an alternative magnetic field; a second closed magnetic circuit, also constituted of an anisotropic material through which flows an adjustable direct current magnetic flux; the first and second magnetic circuits being so disposed relative to one another as to define at least two common magnetic spaces in which the respective alternative and direct magnetic fields are superimposed orthogonally to orient the magnetic dipoles of the common spaces following a direction determined by the intensity of the magnetic flux of the second circuit and thereby to control the permeability of the first magnetic circuit to the alternative field.

Preferred embodiments of the present invention will be hereinafter described with reference to the accompanying drawing wherein.

Figure 6:
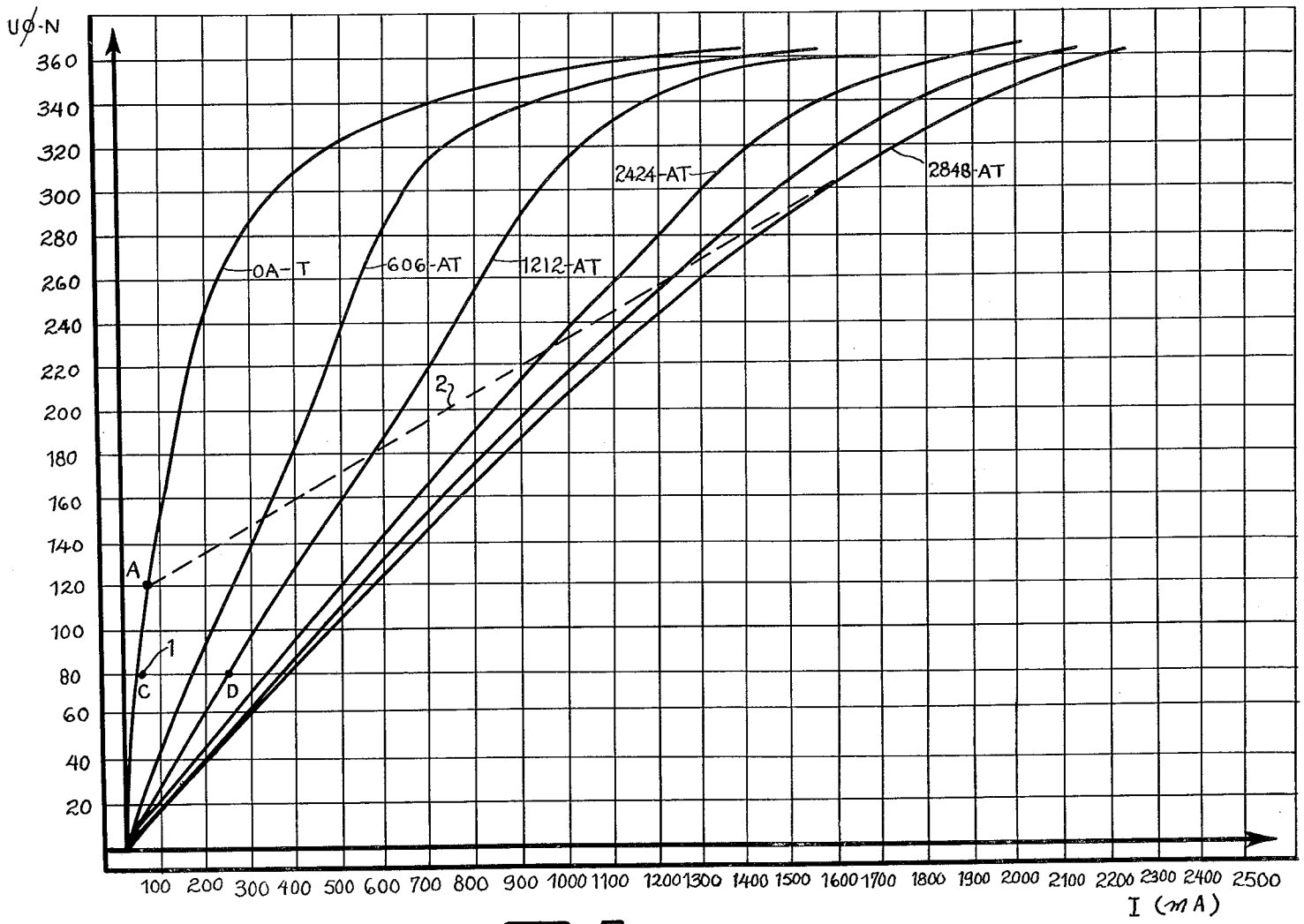
Figure 7:
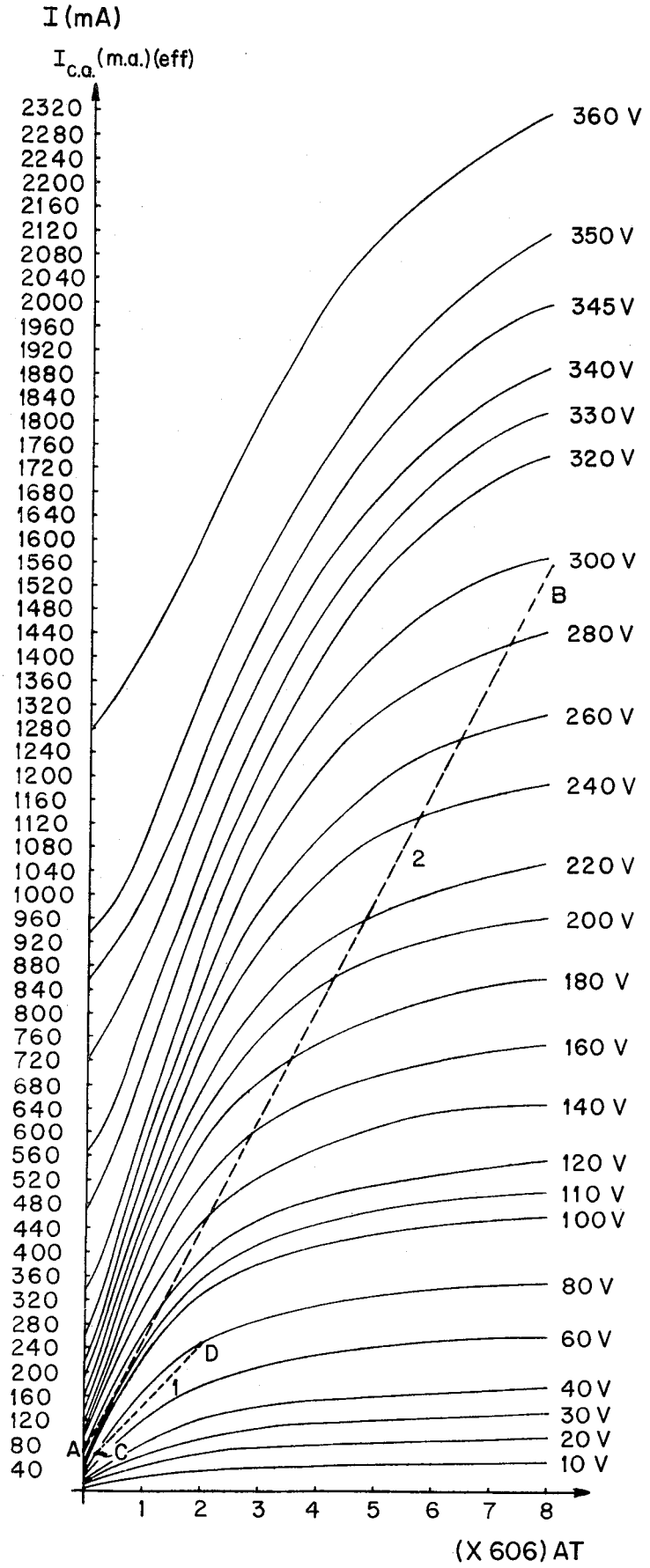
Figure 8:
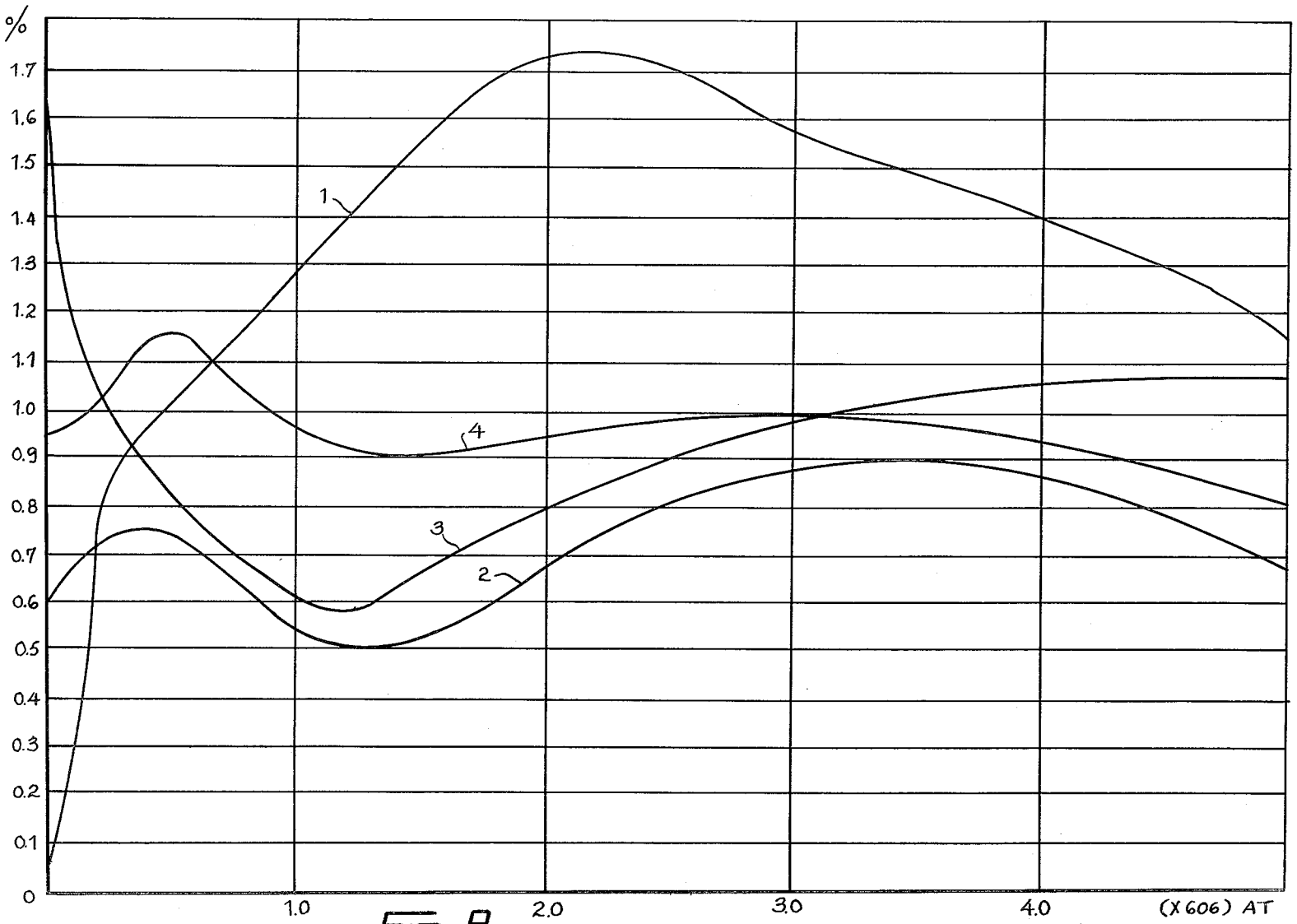
Figure 9:
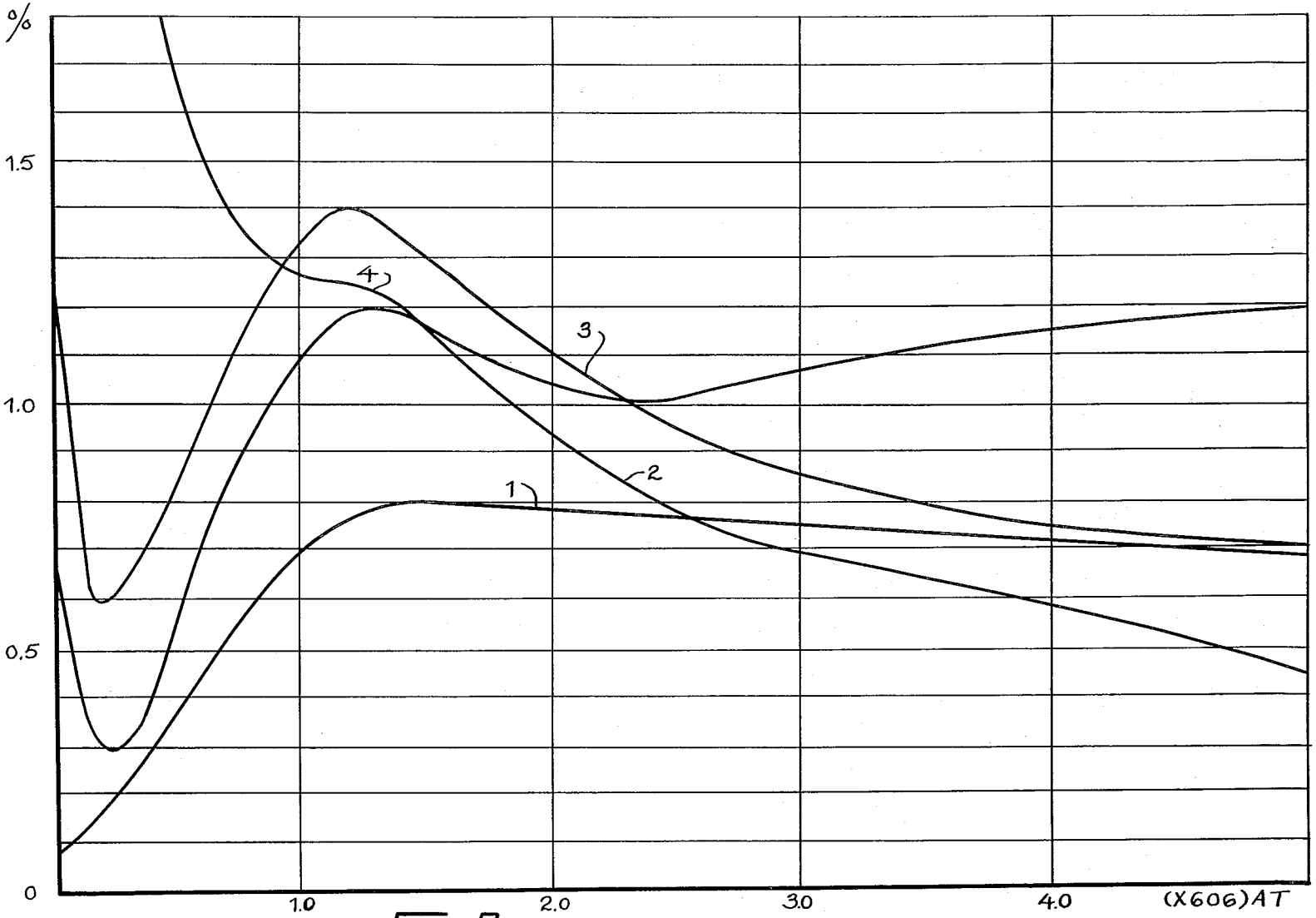
Figure 10:
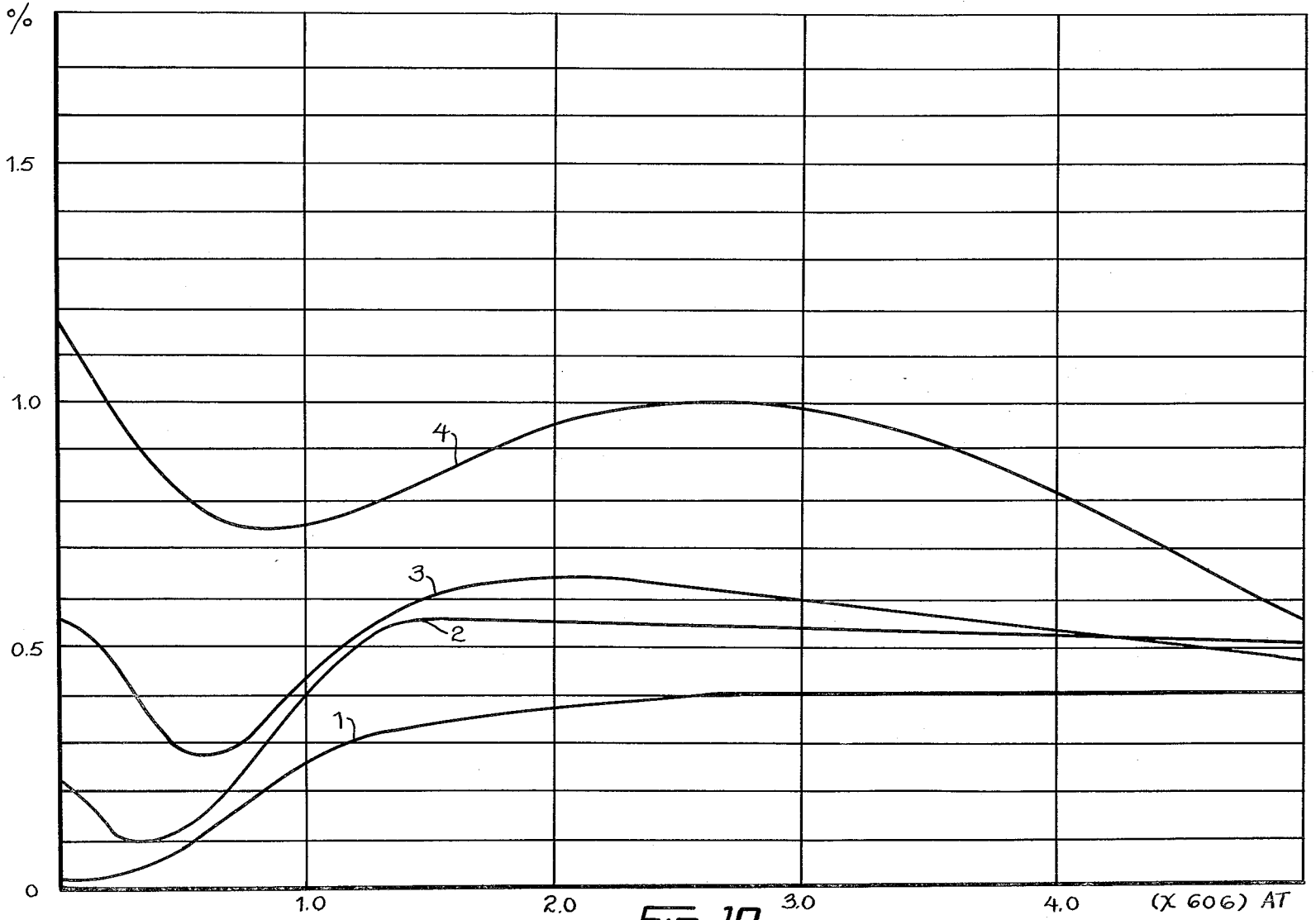
Figure 11:
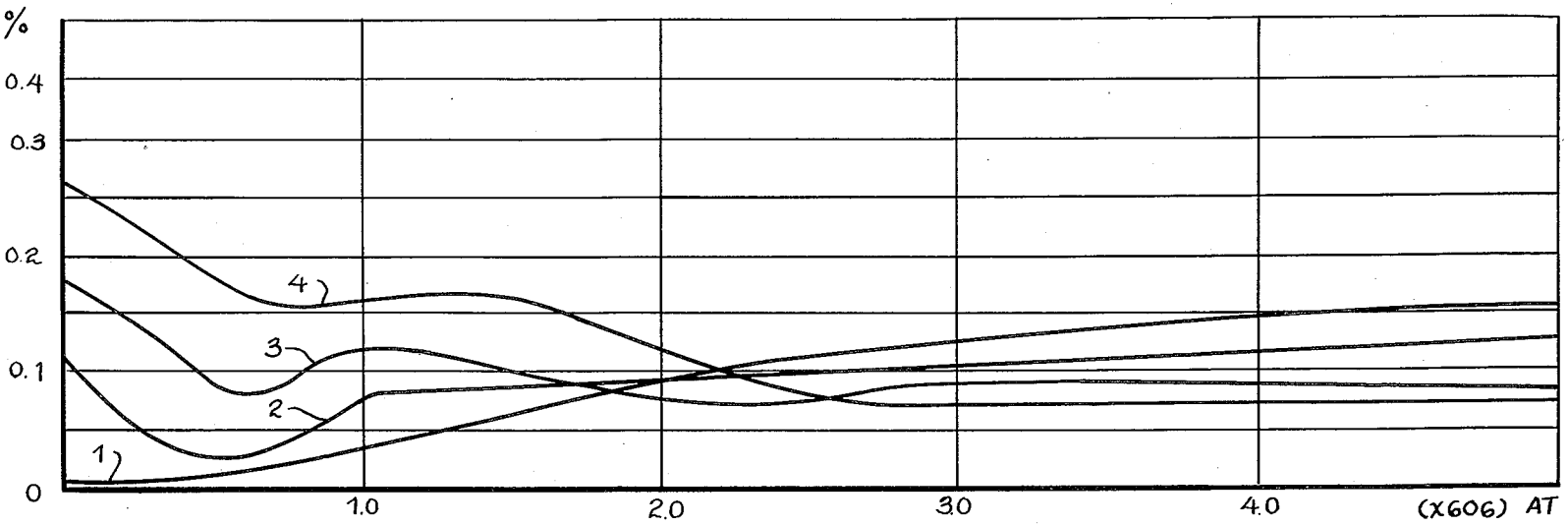
Figure 12:
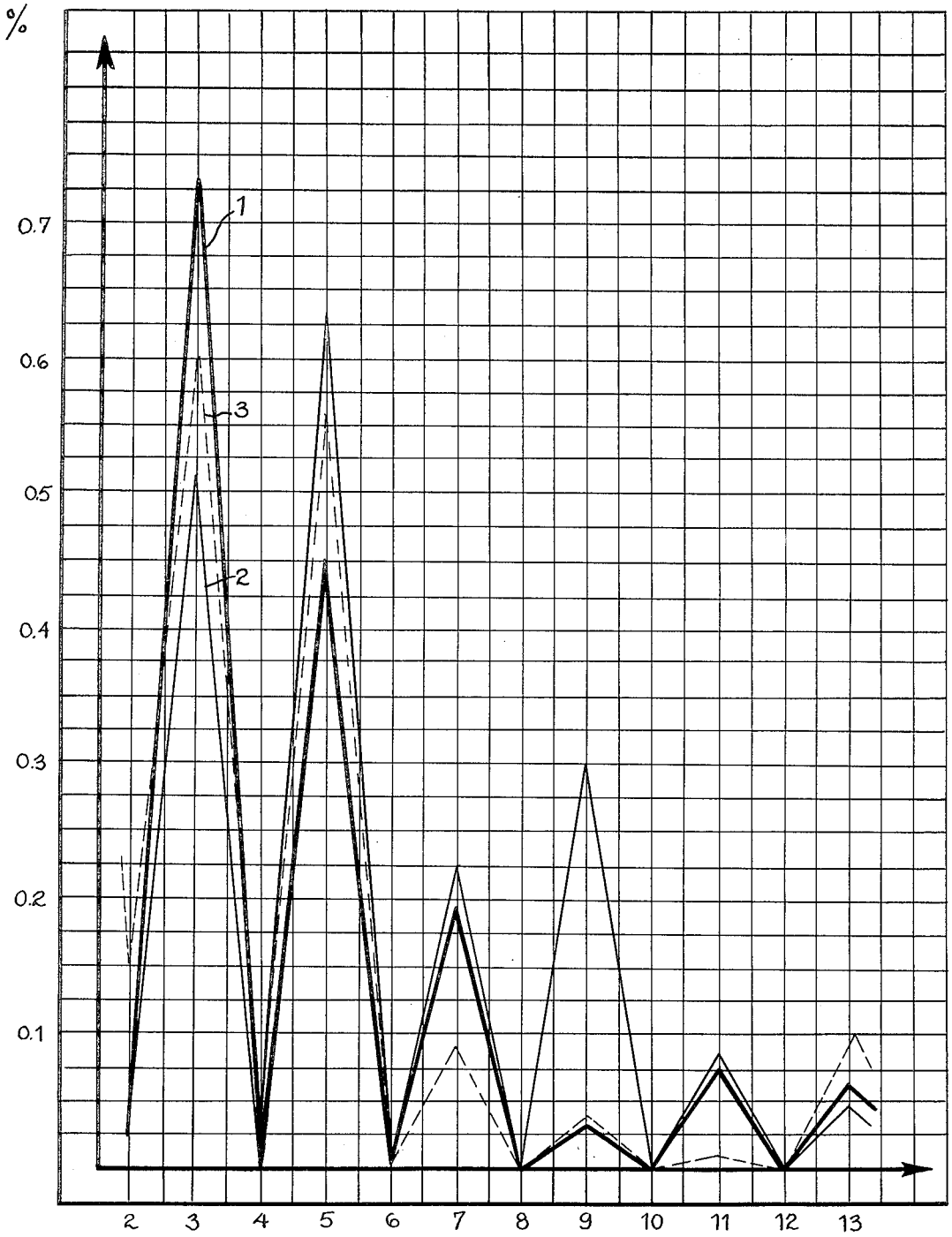
Figure 13:
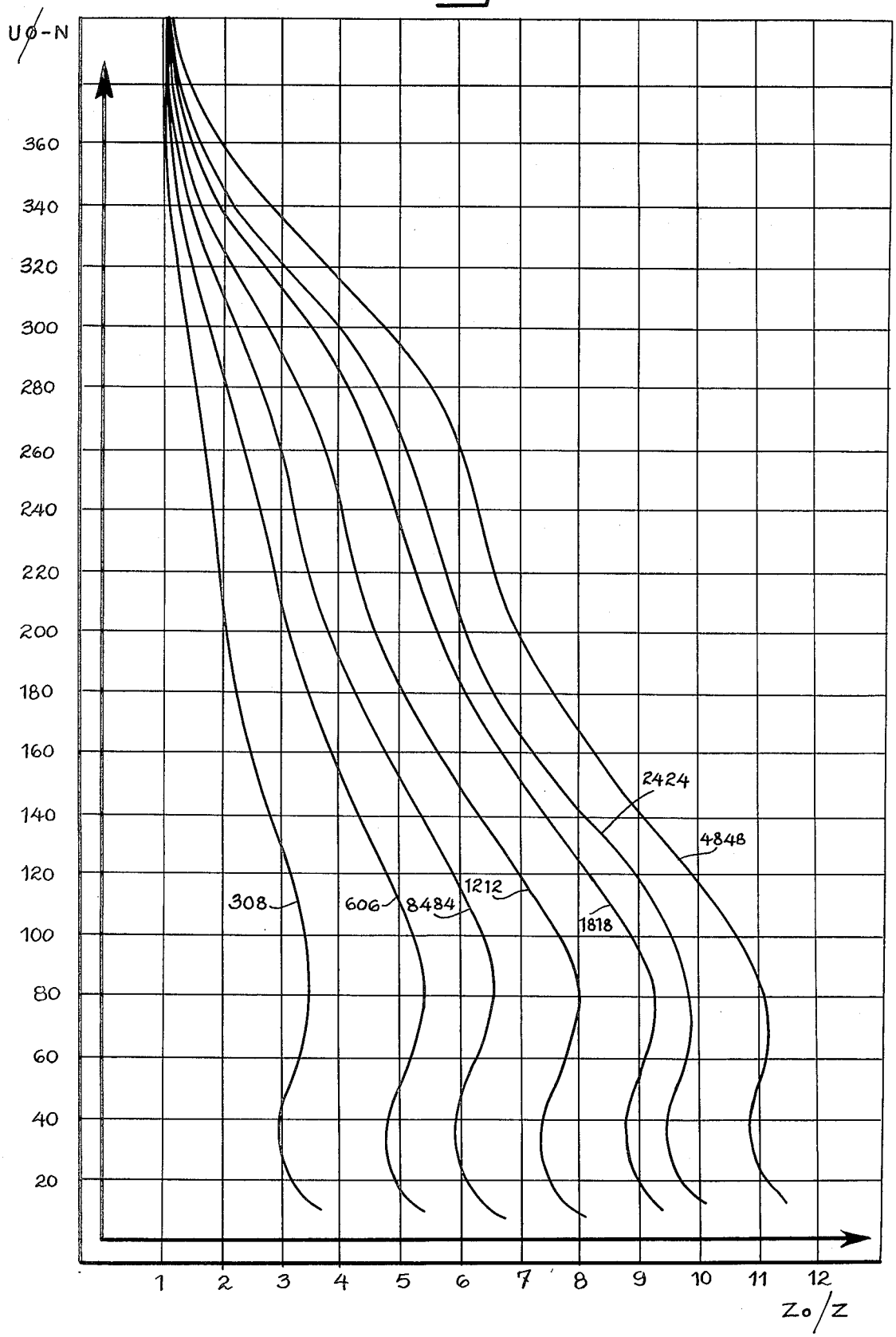
Figure 15:
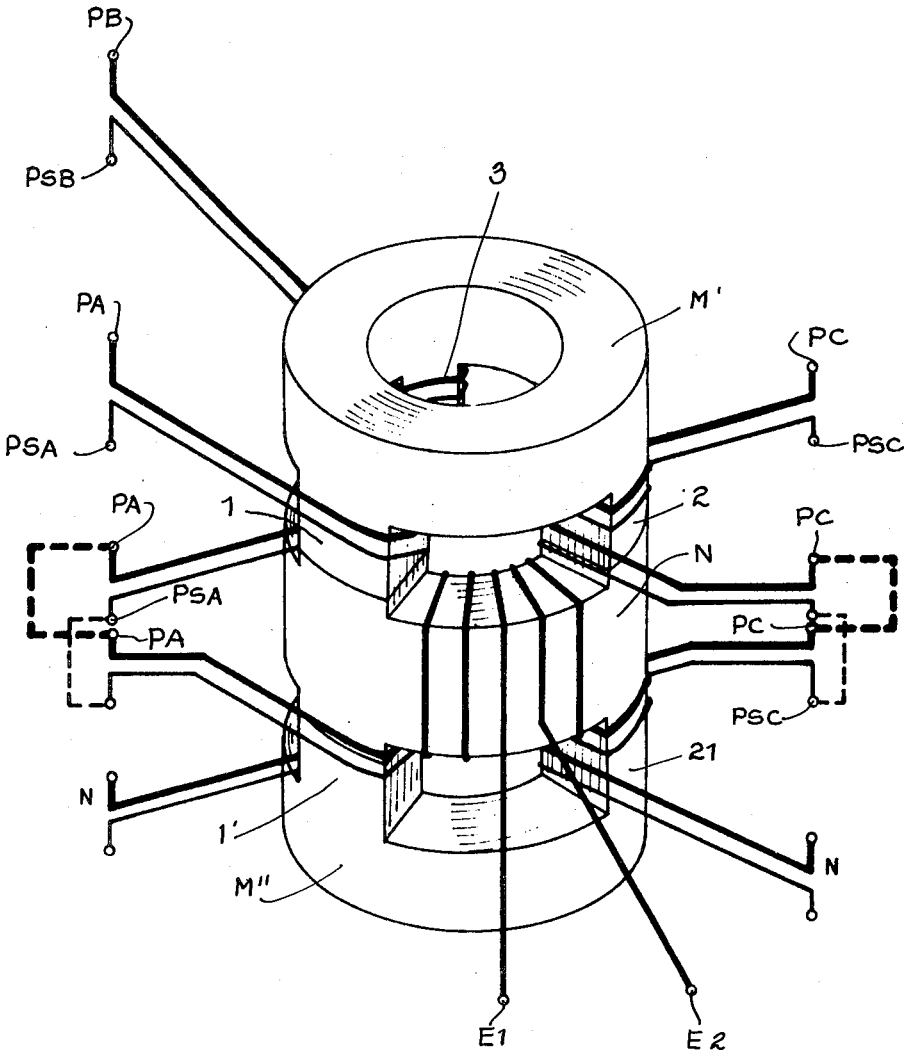
Figure 16:
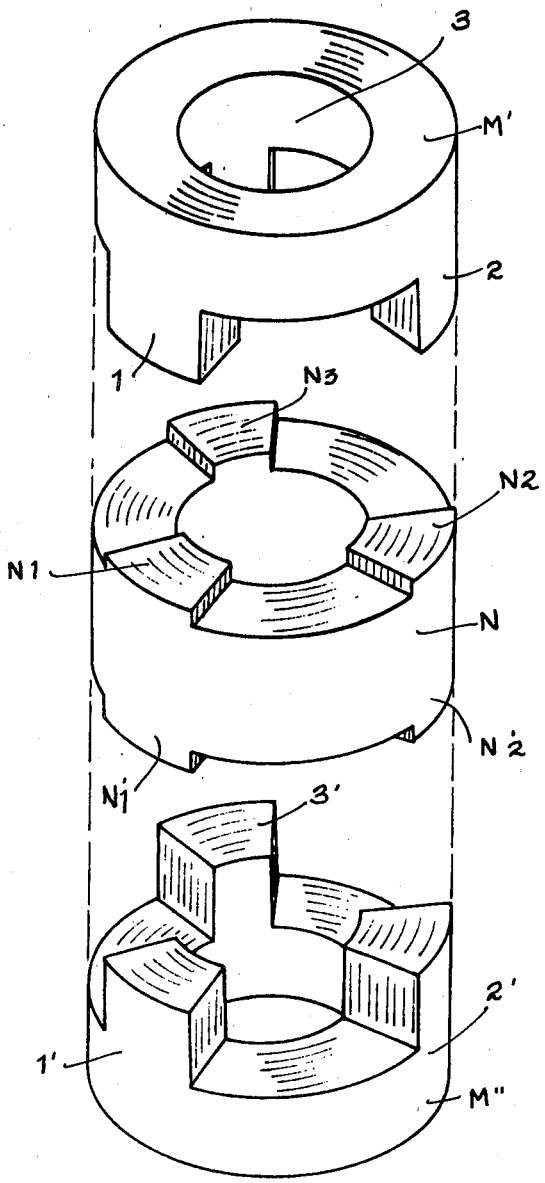
Figure 17:
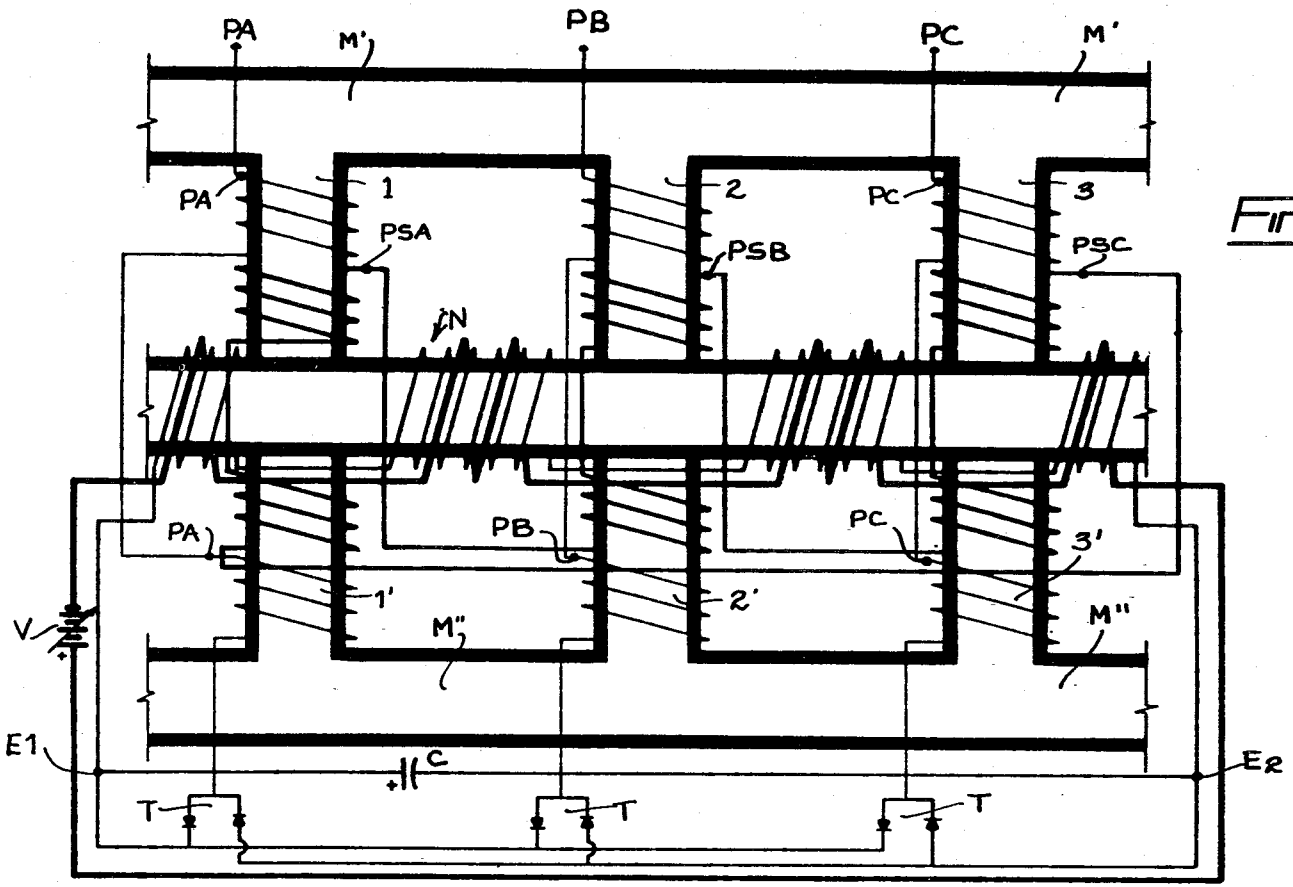
Figure 18:
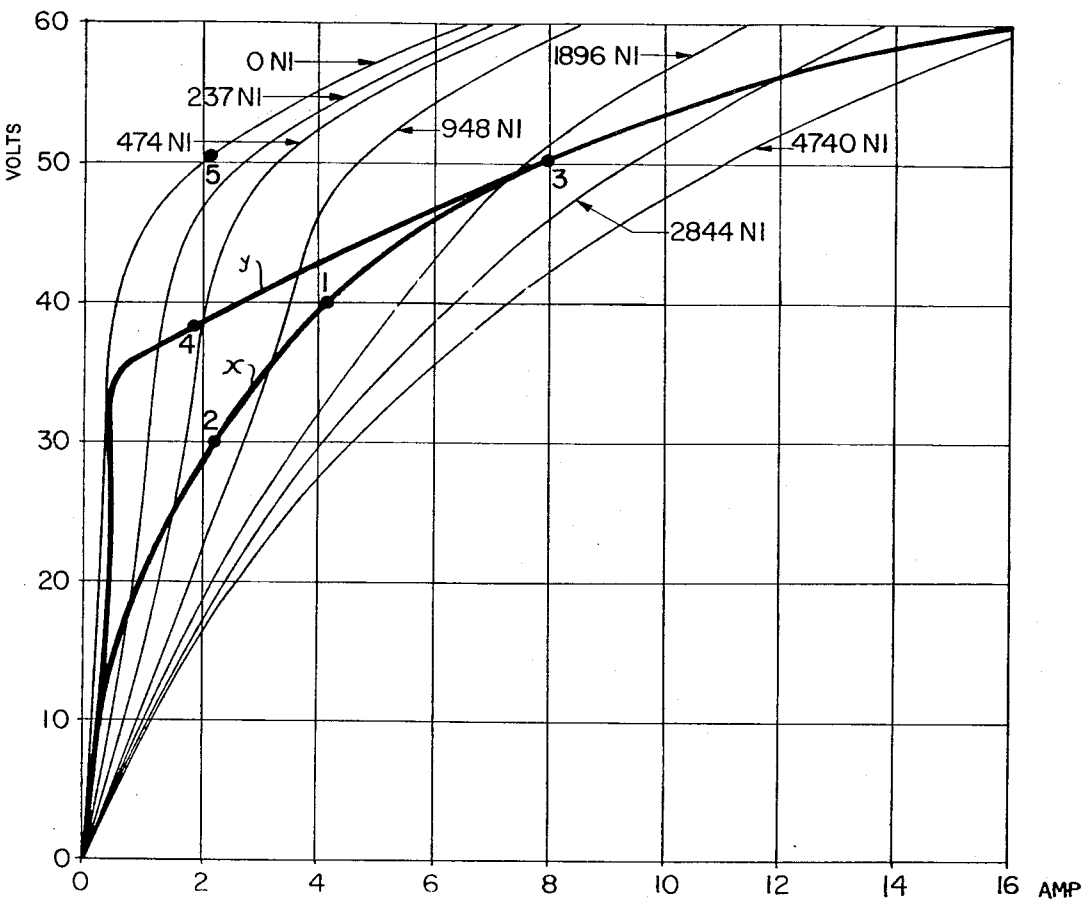
Figure 19:
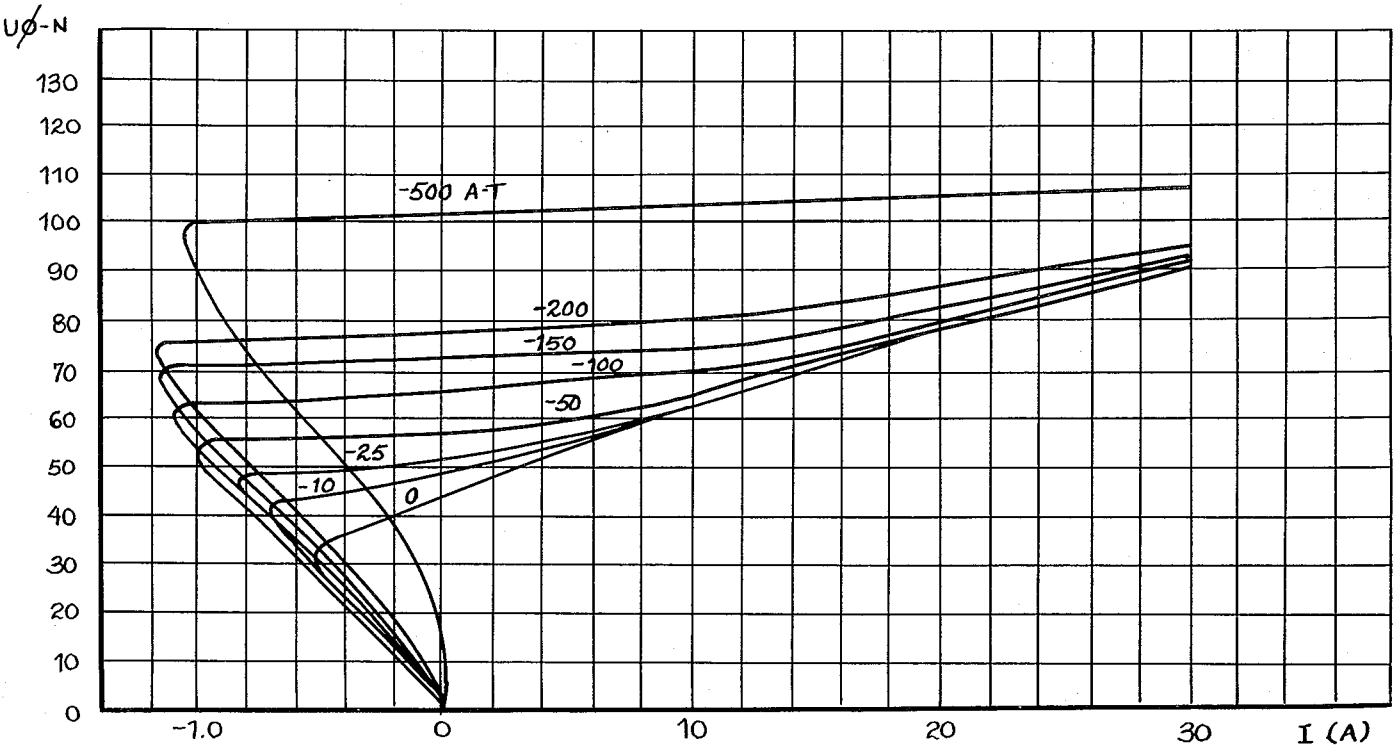

FIG. 6 presents single phase variation curves of the three-phase inductor;

FIG. 7 presents saturation curves in function of the controlled current of the three-phase variable inductor;

FIGS. 8, 9, 10 and 11 respectively show curves relative to the harmonic rates of the third, fifth, seventh and ninth harmonic currents in function of the ampere-turns of the control direct current field;

FIG. 12 presents a voltage distortion curve in function of the harmonics;

FIG. 13 shows impedance ratio curves in function of the ampere-turns of the control circuit of the three-phase inductor;

FIGS. 14*a* to 14*e* are active and reactive power curve for the three-phase inductor;

FIG. 15 illustrates another arrangement of the variable inductor useful in three-phase circuits, but of a cylindrical configuration;

FIG. 16 is an exploded view of the variable inductor illustrated in FIG. 15;

FIG. 17 is a connection diagram of the inductor of FIG. 15 connected up in self-control and inverse control;

FIG. 18 shows the operation domains of the three-phase variable inductor of FIG. 17;

FIG. 19 shows the operation domains of a static compensator using the three-phase inductor according to the present invention; and FIGS. 20*a* and 20*b* show the connection of capacitors in parallel and in series to the input terminals of FIG. 17.

Figure 1:
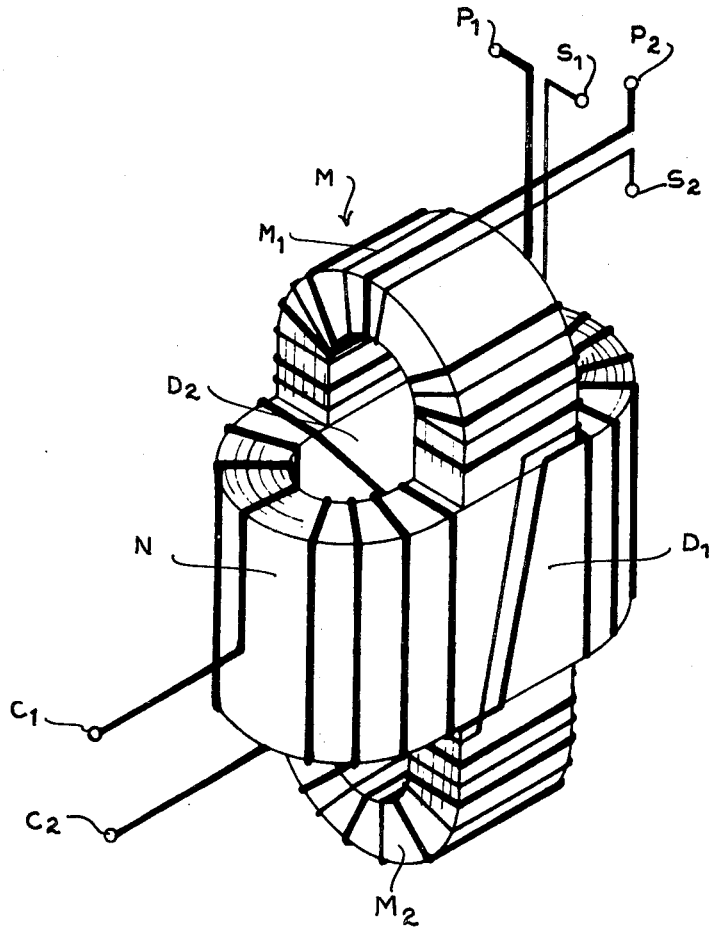
FIG. 1 shows a first embodiment of the variable inductor according to the present invention, for a single phase circuit.

FIG. 1 illustrates an embodiment of a single-phase variable inductor constituted of two magnetic circuits M and N which are orthogonally mounted. The magnetic circuit M is formed of a core divided in two parts M1 and M2 and of magnetic areas or spaces D1 and D2 common to both magnetic circuits. That magnetic circuit M is excited through an alternative current winding P1, P2 which extends on both parts M1 and M2 of the magnetic core M. On the other hand, the magnetic circuit N is constituted of a single core through which flows a magnetic field excited by a direct current winding C1, C2. Such orthogonal arrangement of the two magnetic circuits results in the setting-up within the common magnetic spaces D1 and D2 of a magnetic torque proportional to the value of the direct current magnetic field in core N, which torque biases the dipoles of these common magnetic spaces. Pursuant to that orthogonal arrangement, the respective magnetic flux cannot take the same path so that the direct current magnetic field orients, by polarizing, the magnetic dipoles of the common spaces to define the permeability of the magnetic circuit excited by the alternative current winding in accordance with the amplitude desired.

In that arrangement, cores M and N are made of ferromagnetic materials having a same cross section, either in ferrite or in laminated iron, and therefore possess inherent anisotropic characteristics. Thus, in the absence of any direct current polarizing field in core N, the dipoles in the common spaces D1 and D2 are virtually oriented in the direction of the alternative magnetic field, the permeability of core M corresponding then to a measure of the easiness with which the magnetic dipoles orient themselves in the direction of the exciting field. The inductor becomes saturated when the dipoles of core M are completely oriented in the direction of that magnetic field. Consequently, the superposition of a direct current magnetic field N following a direction transverse to that of the alternative magnetic field M, results in a polarizing action on the dipoles to put them off their equilibrium position, so that the amplitude of the alternative magnetic field M must increase to cause each dipole in the common magnetic spaces D1 and D2 to remain in the same equilibrium position. This method of operation does not affect the leakage inductance but only the magnetizing inductance of the variable inductor. As a result, the saturation magnetic inductor is increased and the magnetization curves become more linear with the increase of the direct current magnetic field in the common spaces D1 and D2. Therefore, applying a direct current magnetic field at right angle with an alternative magnetic field produces a variable air-gap effect in the alternative magnetic circuit.

In the arrangement of FIG. 1, the contact areas between the magnetic circuits M and N are worked and tightened mechanically one upon the other or any other equivalent mounting process may be used, whereas the direct current winding C1 and C2 is fed from an auxiliary source supplying an adjustable and constant direct current. The secondary winding S1, S2 superposed to the primary winding P1, P2 allows the filtering of the harmonics of the homopolar components and, further, the connection of that variable inductor to a utility circuit.

Therefore, the operation principle of the single-phase variable inductance essentially resides in producing within the common magnetic spaces a direct current magnetic field which contravenes to the rotation of the dipoles in those common space so as to control adequately the effective permeability of the alternative magnetic circuit. Also, it is to be noted that the common magnetic domains may be set as well in the phase core M rather than in the control core N as illustrated.

Figure 2:
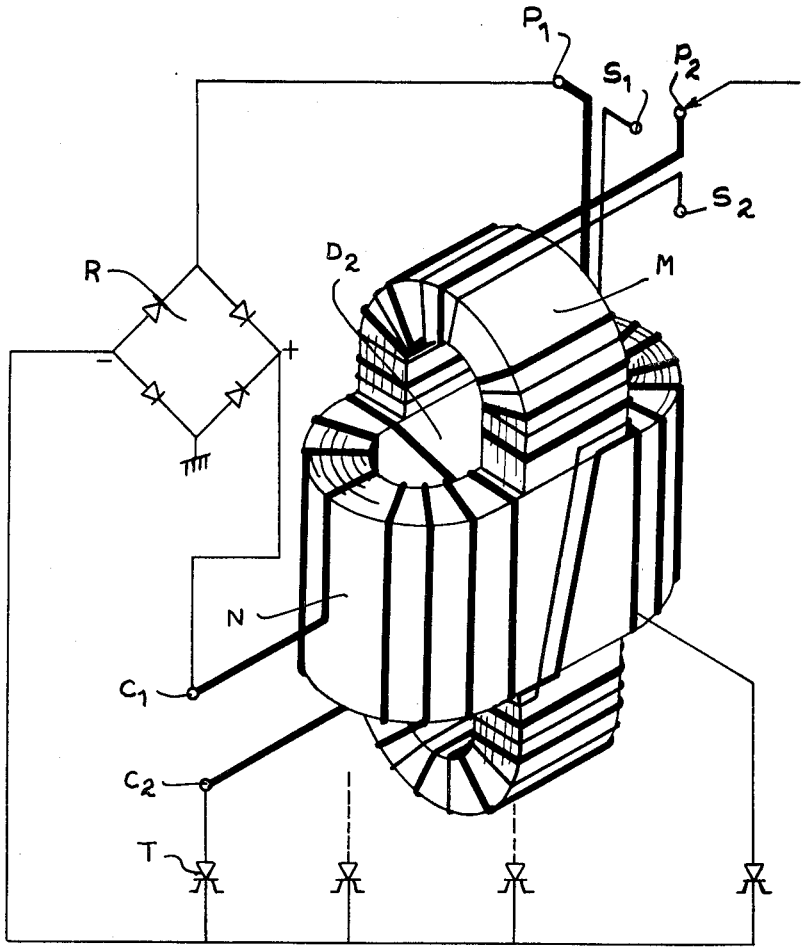
FIG. 2 illustrates a variant of the inductor of FIG. 1, incorporating a self-regulated control circuit.

FIG. 2 shows the connection diagram in self-control of the single-phase inductor of FIG. 1 and wherein a double rectifying diode bridge R is inserted between the alternative winding P1, P2 and the direct winding C1, C2 of the inductor. That arrangement permits to vary continuously the permeability of the inductor in function of the steep variations in the alternative magnetic flux. More particularly, FIG. 2 advocates the use in the three-phase mode of the variable inductor of FIG. 1. For that purpose, secondary winding S1, S2 is connected in a delta configuration with the two other phases so as to filter the third and ninth harmonic components of the alternative magnetic flux. The primary windings P1 and P2 are then interconnected in star with a floating neutral. In this case, the three-phase excitation windings may be interconnected either in series or in parallel.

In the single-phase embodiment of the variable inductor it is to be noted that there exists no alternative voltage induced in the direct current control windings N, the alternative f1 in the direct current core is limited to the zone of the common magnetic spaces D1, D2 and the variation range of the reactive power may reach a ratio of 25/1. Such self-control, through a rectified current, results in a modification of the front slope of the magnetization curve and a displacement of the operating domain of the inductance over the various magnetization curves to levels which are function of the voltage of the alternative source. Thus, the reluctance of the alternative current magnetic circuit M is self-modified, and in the correct direction, according to the alternative voltage levels applied, which reveal to be outstanding for cases of large voltage variations, for example, in cases of overvoltages and unloadings in a power transmission line.

On the other hand, in order to regulate the voltage to obtain a slope of about 3 to 10% according to an operator's choice, the number of turns of the alternative exciting coil may be modified by means of thyristors T under the control of a reference voltage, resulting in a displacement of the curve of the operation domain of the inductor.

It is to be noted that the response time of the variable inductor, when used in self-control, is almost instantaneous, that is the response time will be lower than one period. Concerning the regulation control time, it will vary according to the control mode used and may reach one or two periods (on a 60 Hertz basis) according to the user's needs.

In the single-phase set-up of FIG. 1, the Foucault current and hysterisis losses are considerably reduced through the use of ferrite to form the direct current magnetic circuit N. In addition, the circuit geometry, the type of core used, the length of the magnetic circuit constitute further parameters which serve to reduce losses.

Moreover, in the self-control mode of the single-phase variable inductor of FIG. 2, there is achieved a low power inverse control of the direct current magnetic field in core N. For that purpose, a second winding is superposed to the winding C1–C2 and is supplied by a low power adjustable and constant direct current source. That supplementary winding is mounted so that the magnetic field thereby generated through the control core N is set in opposition to that generated by the self-control winding C1–C2. The resulting magnetic field in the control core will then be related to the magnetic field generated by the rectified alternative current that flows in the self-control winding, and therefore related to the intensity of the voltage across terminals P1–P2 of the variable inductor. The operation of that control mode is simple and does not require any feedback loop to correct the magnetic torque desired on the dipoles of the common magnetic spaces D1–D2.

Figure 3:
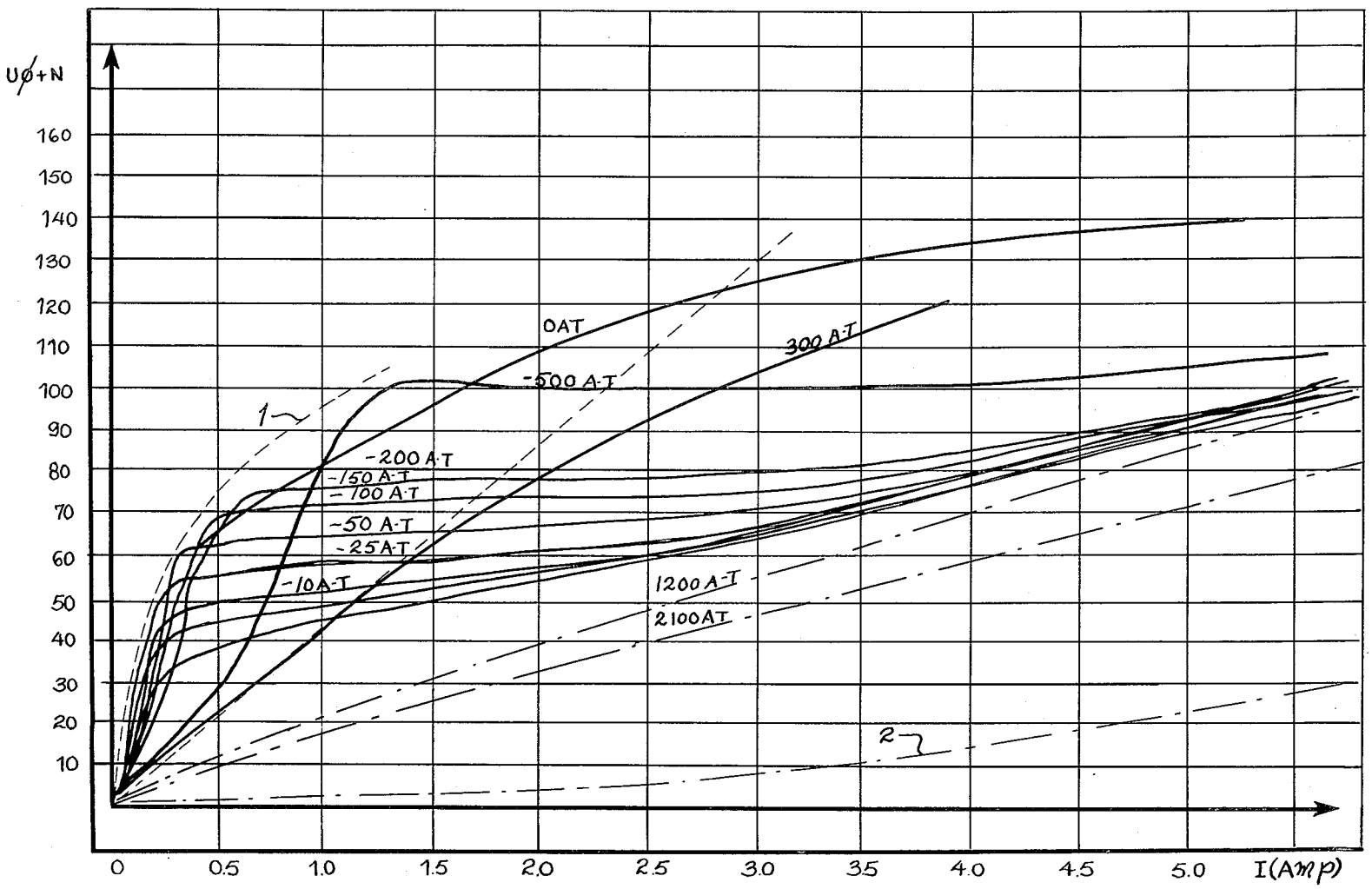
FIG. 3 illustrates the operation ranges and domains of the variable mono-phase inductor.

FIG. 3 gives the operation ranges and domains of the single-phase variable inductor in the self-control mode, as illustrated in FIG. 2. For comparison purposes, in that figure, the dotted curve 1 is a magnetization curve of the alternative current core in closed loop and without any control core N, whereas the dotted curve 2 corresponds to the magnetization obtained when the common ferromagnetic space is replaced by a piece of wood of an equivalent thickness. To obtain the various negative ampere-turn curves, a supplementary winding has been superposed to the self-regulation winding of FIG. 2, which supplementary winding is fed by a constant but adjustable direct current so as to define an inverse control. Under those conditions, the operation curve is being modified to present, as it is illustrated, a sharper knee in the regulation zone required. The dotted line of curve 3 corresponds to an impedance curve $-Zc$. On that graph, three distant magnetization zones or areas may be defined a voltage increasing area for an alternative voltage across the terminals of the inductor ranging from 0 to slightly above the curve knee and wherein the slope of each curve of the operation domains is particularly large; a regulating area corresponding to an alternative source voltage across the terminals of the inductor varying about the curve knee and wherein the slope of each of the curves is rather low, which means that a low variation in the alternative voltage across the inductor terminals produces a large variation in the inductor current; and an overvoltage area corresponding to an alternative source voltage across the inductor terminals much larger than that at the knee and wherein the slope of each of the curves is greater than that at the regulating area. It is therefore seen that the more the alternative current source voltage across the inductor terminals is large, the higher is the polarization of the dipoles in the common magnetic space of the variable inductor and the more marked the tendency of the operation domains towards a magnetization curve corresponding to a circuit where the common magnetic space would be formed of a non-magnetic material (curve the direct current control therefore producing an air-gap effect in that common magnetic space.

Figure 4:
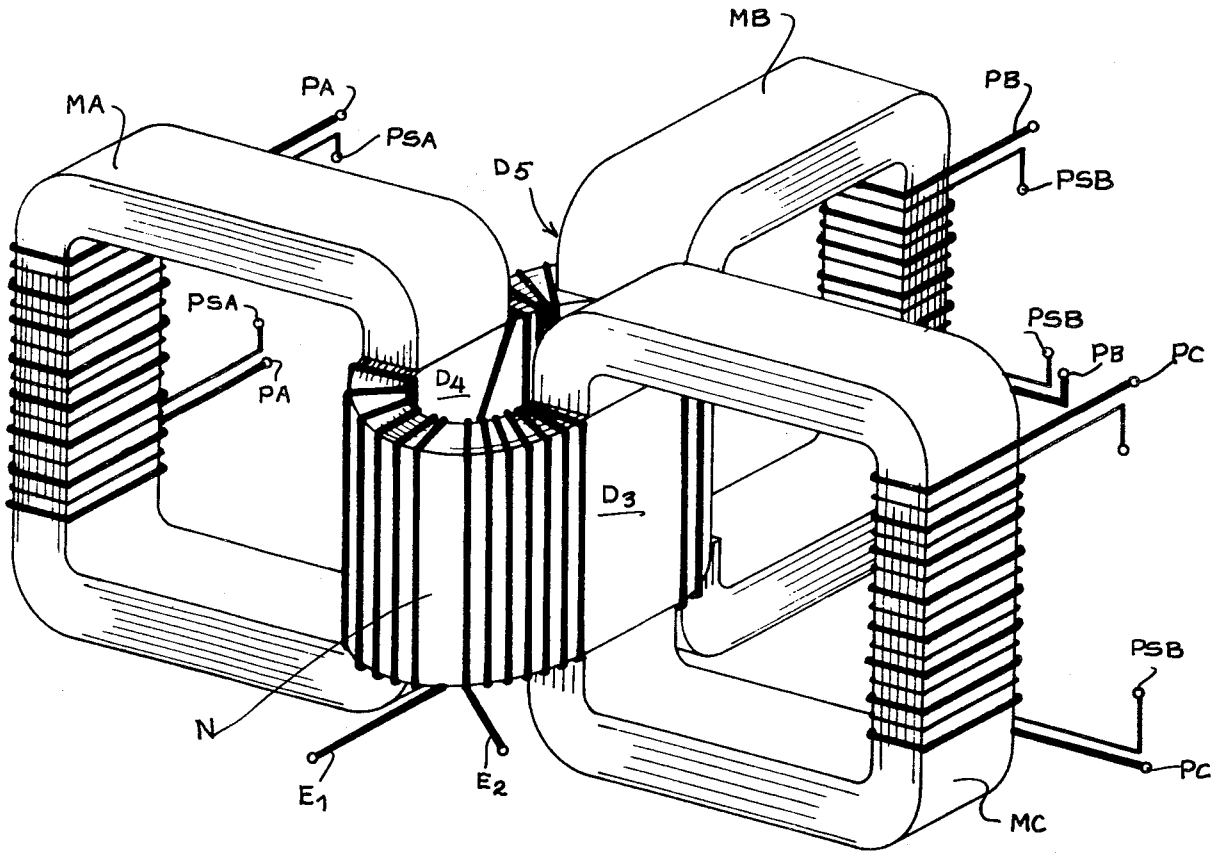
FIG. 4 depicts another embodiment of the variable inductor, for three-phase circuits.

In FIG. 4, there is shown a three-phase embodiment of the variable inductor. Each of the phases PA, PB and PC are respectively connected to cores MA, MB and MC having a same cross-section and through each of which flows an alternative magnetic field of a corresponding phase. Each core has a branch orthogonally mounted with respect to the control core N which has its winding E1–E2 excited by a constant but adjustable direct current source. In this embodiment, the control circuit being common to the three phases, the induced voltages at 120 Hertz in the direct current control coil N are effectively cancelled, as in the case of the previous single-phase embodiment, and there exists no alternative flux in that direct flux core, except in the common space areas D3, D4 and D5.

In that three-phase model, the phases of cores MA, MB and MC are not set following a symmetrical arrangement so that that circuit does not offer maximum operating characteristics, in terms of the phase core length, to their connection points and their geometrical arrangement with respect to the control core N.

Figure 5:
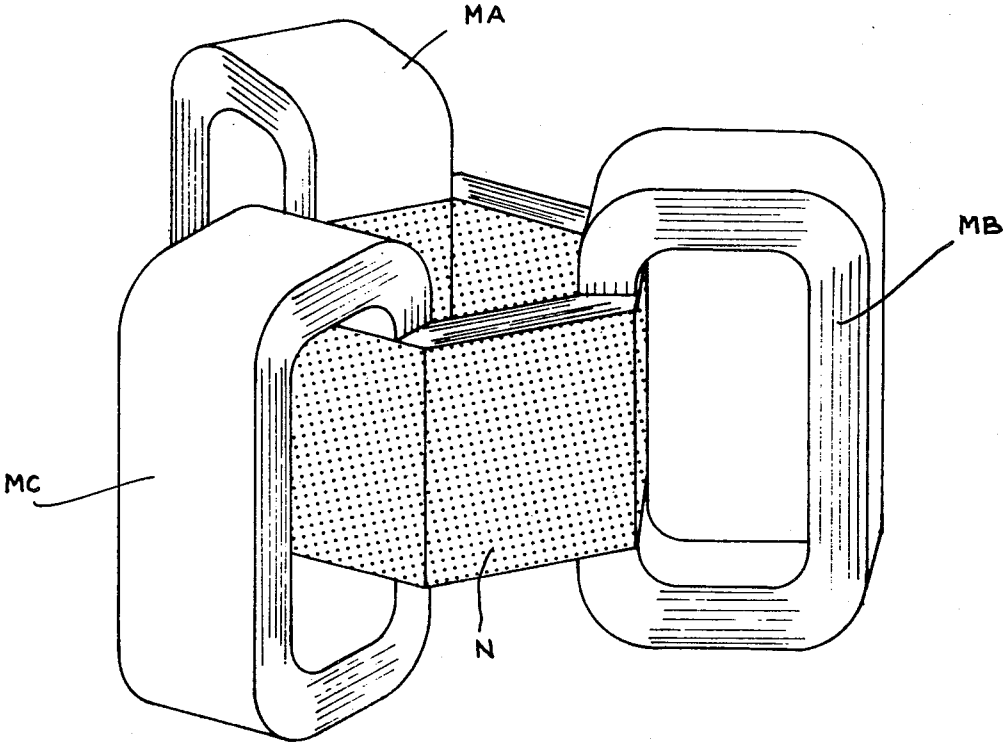
FIG. 5 is a variant of the three-phase circuit of FIG. 4, having a hexagonal control core.

FIG. 5 illustrates a symmetrical arrangement of the three-phase variable inductor wherein the phase cores MA, MB and MC are set at an angle of 120° with respect to one another and are mechanically mounted onto the control core N which is hexagonally shaped. That arrangement of FIG. 5 offers a range of variations in the impedance in the same order as in the previous case and a substantial reduction in the relative losses, thereby allowing an increase in the quality coefficient of the inductor. Such an arrangement does not show any magnetic leg in the feedback flux under the transient working conditions of the inductor.

The arrangements of FIGS. 4 and 5 permits to eliminate the third and ninth harmonic currents through a star connection of the three phases PA, PB and PC, with an ungrounded floating neutral, and to eliminate the third and ninth harmonic flux by means of a superposed secondary winding PSA, PSB and PSC which are interconnected in triangle. Moreover, any leakage in the control core N is substantially reduced due to the fact that no bidirectional reaction stands between the control core and the phase cores since there is no alternative magnetic flux standing in the control core N, the added effects of the three phases being nul. In addition the neutral of the star-connected arrangement being insulated against ground, there is no possibility for the homopolar components of the current to be set up under the transient working conditions.

In the three-phase arrangement, the variable inductor of FIGS. 4 and 5 offer the further advantage, when compared to the use of three single-phase inductors as in FIG. 2, in that the same quantity of control energy is required for the three-phase set as that it would be required for a single phase, so that the energy losses in the control are much less and distributed over the three phases.

Moreover, in those three-phase inductors, the control of the direct current magnetic flux may be effected through a self-control by means of diode bridges as in the case of the single phase inductor of FIG. 2, or even more through an inverse control by means of a constant and adjustable direct current winding superposed to the self-control winding onto the control core N.

FIG. 6 shows variations in the impedance of the three-phase inductor of FIG. 4 in function of an increase in the ampere-turns injected in the control core N. It is noted that the impedance V/I of each phase varies following a ratio reaching 11/1 in the case of a direct current magnetic field varying from 0 to 4,848 ampere-turns. For comparison purposes, it is noted that with the single-phase arrangement of FIG. 1, impedances varying in a ratio of 20/1 for laminated iron material and of 25/1 for ferrite material have been obtained. The family of impedance curves of FIG. 6 gives results for phase "A" only designated by PA, of that three-phase inductor. The dotted line 1 shows the behaviour of the variable inductor when under a measured phase-neutral effective voltage of 80 volts. The dotted line 2 shows the behaviour of the variable inductor when connected in series with a capacitor and the resultant of which is inductive. In the latter configuration, the value of the capacitor used is of 200 $\mu$F and the three-phase source is maintained at a fixed effective voltage of 120 volts across the circuit terminals. The increase in volts-amperes in the variable inductor in the case of a displacement from point A to point B taken along the curves is of 360 volts-amperes in three-phase for 4,848 ampere-turns. Such increase in power is of about 1.78 times greater than in the case of the inductor alone under the same voltage.

FIG. 7 shows a set of saturation curves in accordance with the effective values of the alternative current and with the ampere-turns of the direct current control in terms of the phase-neutral voltages given in effective values. That FIG. 7 gives information on the behaviour of the dipoles in the magnetic space common to both magnetic circuits. It is noted that there exist on each of those curves a non-saturated area and a saturated area. In the non-saturated part, each curve has a slope which becomes larger and larger as the density of flux in the magnetic circuit excited by the alternative current winding increases. Regarding the saturated area of each of these curves, it is due to three factors: to the leakage flux associated with the direct current magnetic circuit; to the distortion of the flux in the magnetic space common to both circuits; and to the distribution of the voltages across the impedance terminals and of the magnetization of the alternative current circuit. It is well seen that the maximum variation in the inductor impedance is in function of the density of the alternative and direct current flux in the common magnetic space. That set of curves renders easier the selection of the operating points for the variable inductor either where the inductor alone is used (curve 2) or where the inductor is in series with a capacitor (curve 1).

FIGS. 8, 9, 10 and 11 respectively give the harmonic ratios of the third, fifth, seventh and ninth harmonic currents in function of the ampere-turns of the direct current. Those harmonic ratios has been computed with respect to a full load alternative current which corresponds to a direct current of 5.0 (×606) ampere-turns.

As shown on FIGS. 8 to 11, the harmonic ratios, which have been calculated for one phase only of the three-phase inductor of FIG. 4, are very low and even trifling for some harmonic components. On those figures, curves 1, 2, 3 and 4 correspond to tests effected under voltages having effective values of 80 volts 160 volts, 200 volts and 280 volts, respectively. It is to be noted that there exists a current of third (FIG. 10) and of ninth (FIG. 13) harmonics despite the fact that the primary windings are star-connected with insulated neutral. The asymetrical arrangement of the magnetic circuits of FIG. 4 play an important part in that phenomenon. Indeed, the control core is made oval and the phase cores are not mounted at 120° with respect to one another and to that control core. Improved results are obtained with the three-phase inductors of FIGS. 15 and 16 wherein the phase cores are well set at 120° and wherein the control core is made cylindrical.

FIG. 12 shows distortion curves for a phase-neutral voltage having an effective value of 180 volts in function of the harmonic components generated by one phase of the three-phase inductor. The curve designated 1 gives results measured for the network alone whereas curves 2 and 3 present the results obtained when the variable inductor is connected to the network and where the control flux is nul and equal to 1,212 ampere-turns dc, respectively. It is therefore seen that the phase voltage distortion ratio always stands below 1%.

FIG. 13 illustrates curves given various impedance ratios in function of the ampere-turns of the direct current magnetic circuit, and wherein Zo corresponds to the impedance of one phase when the direct current magnetic field is nul, and Z is the impedance of that phase for the indicated ampere-turns of the direct current. It is noted that the impedance ratios decrease with the increase in saturation of the alternative current cores and that, at full saturation, the impedance ratio is equal to 1, since then the dipoles in the common magnetic space made an angle of 0° with the alternative magnetic field vector. However, the higher the transverse direct current magnetic field, the higher the occurrence of the saturation level, as in the case of the control currents of 4,848 ampere-turns dc.

Figure 14A:
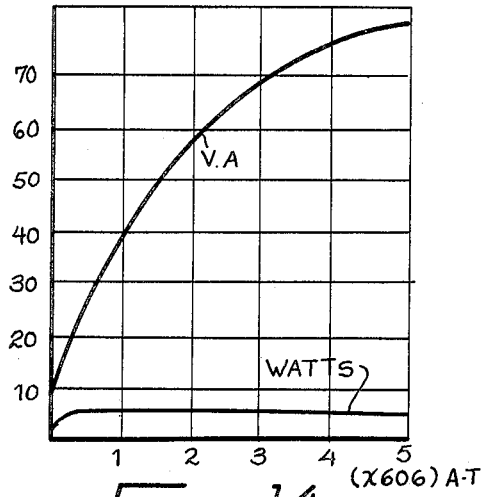
Figure 14B:
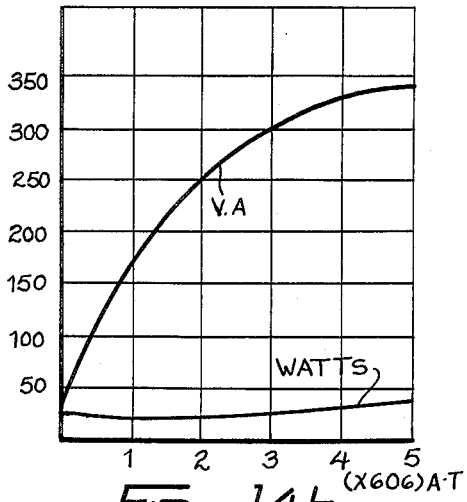
Figure 14C:
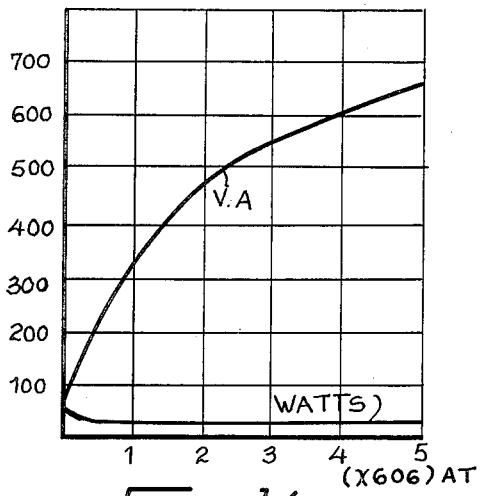
Figure 14D:
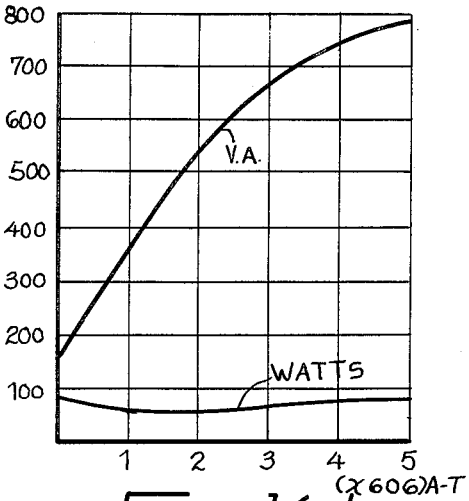
Figure 14E:
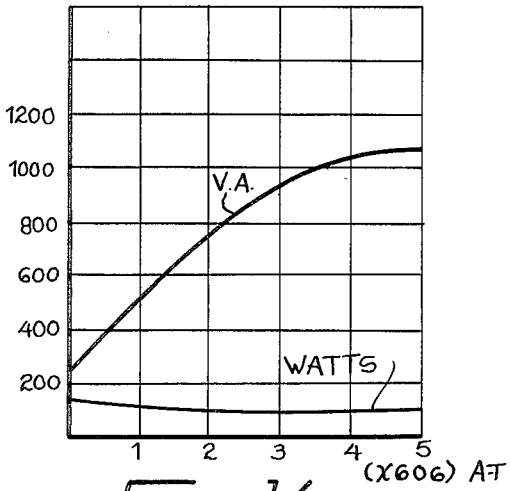

FIGS. 14*a* to 14*e* respectively show three-phase power curves of the varible inductor for phase-neutral voltages of 80, 160, 200, 240 and 280 volts, in effective value. On those graphs the values of the volts-amperes (VA) and the watts of the variable three-phase inductor have been indicated. Except for curve 14*a*, it is seen that the losses decrease as a result of an increase in the transverse direct current magnetic field. In the case of FIG. 14*a*, the increase in watts is related to an increase in the third and ninth harmonic components, as explained previously. Such a decrease of losses in the core due to an increase in the reactive energy of the variable inductor contributes to increase the efficiency of the inductor to around 96% when the direct current magnetic field reaches a value of 3030 ampere-turns.

FIGS. 15 and 16 illustrate another embodiment of the three-phase inductor made of a stacking of cylindrical cores having a same cross section. That arrangement advocates a symmetrical distribution of the phase windings PA, PB and PC around the legs 1-1', 2-2' and 3-3' of cores M' and M'', respectively. The control core N the winding of which is supplied in adjustable direct current through terminals E1 and E2, also comprises legs N1, N2 and N3 which are mounted in registry with legs 1, 2 and 3 of core M', on the one hand, and with legs N'1, N'2 and N'3 mounted in registry with legs 1', 2' and 3' of core M'', on the other hand. The operation characteristics of that three-phase inductor are improved with respect to those mentioned relative to the three-phase inductor of FIG. 4.

When set in self-control, the wiring diagram of the phases and the control coils which include a variable direct current source V supplying an inverse flux, is illustrated in FIG. 17.

The excitation mode proposed in FIG. 17 comprises two superimposed control systems similar to the arrangment described above in connection with FIG. 2: a control fed directly from the high voltage power circuit and an inverse control of low power connected to the constant direct current source V which is adjustable.

In that circuit, the three-phase current is rectified by means of the diode bridges T and flows to the exciting winding E1, E2 to complete its return circuit. A second winding is super imposed onto the first one in the control core and is fed by the low power constant direct current source V. The latter winding is mounted such that the direct current magnetic field generated in the control core N is set in opposition to the main direct current magnetic field generated by the self-control winding. The resulting magnetic field in the control core will then be in function of the magnetic field generated by the three-phase alternating current rectified by T, which circulates in the self-control winding, and, consequently, will be in function of the voltage level across the terminals of the variable inductor. The operation principle of that control is simple and does not require any feedback loop to correct the magnetic torque desired on the dipoles of the common magnetic space N. That magnetic torque is directly generated by the resulting direct current magnetic field injected in the control core and it is important to select adequately the number of turns of the self-control winding in such arrangement.

The following table gives the harmonic distortion ratios for the phase currents which are obtained in cases where the three-phase inductor of FIG. 17 operates either in self-control or in self-control with an inverse control. In that table, the figures in parenthesis refer to the operation points indicated on FIG. 18.

| | SELF-CONTROL | | | | | | SELF-CONTROL PLUS INVERSE | WITHOUT SELF-CONTROL |
|---|---|---|---|---|---|---|---|---|
| | SOURCE = 40 V a.c. | | | CAPACITOR 1000 μF | | | 1.0 A inv. (200 μF) | |
| | 0 μF | 200 μF | 1000 μF | 30 V | 40 V | 50 V | 38 V | 50 V |
| HARMONICS | (1) | (1) | (1) | (2) | (1) | (3) | (4) | (5) |
| FOND. | 100. | 100. | 100. | 100. | 100. | 100. | 100. | 100. |
| 2 | 0.88 | 0.97 | 0.88 | 0.91 | 0.88 | 0.61 | 1.00 | 0.27 |
| 3 | 0.65 | 0.67 | 0.64 | 0.77 | 0.64 | 1.45 | 0.97 | 1.80 |
| 4 | 0.05 | 0.03 | 0.04 | — | 0.04 | 0.16 | 0.07 | 0.12 |
| 5 | 2.02 | 1.50 | 1.50 | 2.30 | 1.50 | 2.20 | 0.97 | 27. |

-continued

| HARMONICS | SELF-CONTROL SOURCE = 40 V a.c. 0 μF (1) | 200 μF (1) | 1000 μF (1) | CAPACITOR 1000 μF 30 V (2) | 40 V (1) | 50 V (3) | SELF-CONTROL PLUS INVERSE 1.0 A inv. (200 μF) 38 V (4) | WITHOUT SELF-CONTROL 50 V (5) |
|---|---|---|---|---|---|---|---|---|
| 6 | 0.03 | 0.07 | 0.01 | — | 0.01 | 0.09 | — | — |
| 7 | 1.01 | 1.26 | 1.20 | 0.82 | 1.20 | 1.05 | 0.16 | 7.50 |
| 8 | 0.02 | — | — | — | — | 0.11 | — | — |
| 9 | 0.04 | 0.02 | 0.01 | — | 0.01 | 0.14 | 0.03 | 1.15 |
| 10 | 0.02 | — | — | — | — | 0.13 | — | — |
| 11 | 0.21 | 0.28 | 0.28 | 0.13 | 0.28 | 0.26 | — | 1.80 |
| 12 | — | — | — | — | — | — | — | — |
| 13 | 0.05 | 0.10 | 0.10 | 0.03 | 0.10 | 0.21 | 0.47 | 0.73 |
| 14 | 0.01 | — | — | — | — | — | — | — |
| 15 | — | — | — | — | — | — | — | 0.04 |
| 16 | — | — | — | — | — | — | — | — |
| 17 | 0.02 | 0.05 | 0.05 | 0.01 | 0.05 | 0.06 | — | 0.36 |
| 18 | — | — | — | — | — | — | — | — |
| 19 | 0.04 | 0.02 | 0.02 | — | 0.02 | 0.09 | — | 0.12 |
| 20 | — | — | — | — | — | — | — | — |
| 21 | — | — | — | — | — | — | — | 0.02 |
| 22 | — | — | — | — | — | — | — | — |
| 23 | 0.01 | 0.01 | 0.01 | — | 0.01 | 0.01 | — | 0.04 |

FIG. 18 shows characteristic curves for the cylindrical three-phase inductor of FIG. 17 in terms of the ampere-turns of the direct current control and in terms of a self-control. More specifically, curve "X" is the one obtained for the operation of the inductor with a self-control alone whereas curve "Y" represents the operation characteristics of the three-phase inductor in self-control together with the inverse direct current supply for the control core.

The variable permeability inductor described above is particularly well suited to be used as a static compensator, when connected in parallel with a bank of capacitors, in the power transmission lines. Indeed, as previously indicated, the response time of the variable inductor is of about or lower than one cycle for a 60 Hertz voltage network and the energy transferred is performed without distortion in the current. Furthermore, the inductor harmonic distortion being very low, no filter is necessitated when the secondary is connected in delta, which goes to decrease very substantially the cost and to increase the reliance of the static compensator. It is also noted that the variable inductor may be connected directly to the high voltage network and that the iron and lead losses compare well with those of a transformer.

Indeed, the control mode proposed for the variable permeability inductor of the cylindrical type illustrated in FIG. 17, is of a particular interest when applied to a static compensator. That three-phase inductor comprises a self-control circuit derived from the inductor rectified current and an inverse control of a low power derived from a separate direct current source. The so-controlled inductor stands as an outstanding means for controlling the energy conveyed by a power transmission line, since the operating zone of that inductor is triple (voltage increase, regulation and overvoltage), the saturation level of the inductor is never reached, the response time to a voltage disturbance on the transmission line is instantaneous and its reliance is particularly great mainly due to the simplicity of design of the control itself. In fact, when used in parallel with a bank of capacitors, the three-phase inductor becomes the variable element of a static compensator since its operation characteristic meet well the present requirements of power transmission networks. Indeed, when an overvoltage occurs on a transmission line, the phase currents pass from a capacitive state to an inductive state in a time interval of about 0.5 cycle, on a 60 Hertz basis. Such transition from the capacitive state, where I is lower than zero, to the inductive state is particularly well shown in FIG. 19 where the curves illustrate the operation domains of a static compensator using a variable inductor having an inverse control varying from 0 to 500 negative ampere-turns. The variable inductor described above therefore allows a transmission without distortion of the current wave, all that has to be adjusted is the angle from +90° to −90° with respect to the supply voltage of the compensator; regarding the distortion in the phase current, it remains negligible.

FIG. 20*a* illustrates a bank of capacitors connected in parallel with the inductor inputs PA, PB, PC of FIG. 17. FIG. 20*b* illustrates a battery of capacitors connected in series with the inductor inputs PA, PB, PC of FIG. 17.

We claim:

1. A variable inductor comprising a first closed magnetic circuit, formed of an anisotropic material through which flows an alternative magnetic field; a second closed magnetic circuit, also formed of an anisotropic material, through which circulates an adjustable direct current magnetic field; said first and second magnetic circuits being mounted with respect to one another so as to define at least two common magnetic spaces in which the respective alternative and direct magnetic fields are orthogonally superimposed to orient the magnetic dipoles in said common spaces following a direction predetermined by the intensity of said direct current magnetic field of the second circuit and thus to control the permeability of said second magnetic circuit to said alternative field, a coil being wound around the anisotropic material of said first magnetic circuit and a coil being wound around the anisotropic core of said second magnetic circuit and connected to a control circuit governing the intensity of the direct current magnetic field, said control circuit comprising a rectifying bridge connecting the alternative field coil to the direct field coil to accomplish a self-control of said variable inductor.

2. A variable inductor according to claim 1, wherein a second coil is superposed to said direct field coil and connected to an adjustable and constant current source so as to induce in the anisotropic material of said first magnetic circuit a magnetic field inverse to that induced by the coil connected to the rectifying bridge so as to produce an inverse control of said variable inductor.

3. A variable inductor to be connected to a three-phase alternative current source, comprising three variable inductors each being identical to said variable inductor defined in claim 2 characterized in that said variable inductors are interconnected according to a star-connection with a floating neutral so as to determine in each inductor an alternative magnetic field corresponding to one phase of said three-phase source and that the second coils are interconnected through a triangle-connection.

4. A variable permeability inductor, comprising ferro magnetic cores coupled each to one phase of a three-phase alternative current source and forming a closed magnetic circuit through which circulates a magnetic field of a corresponding phase; a ferromagnetic control core forming a closed magnetic circuit through which circulates an adjustable direct current magnetic field; each of said phase cores being disposed with respect to said control core so as to define therebetween a common magnetic space wherein the alternative magnetic field of each phase and the direct current magnetic field are superimposed following an orthogonal plane to orient the magnetic dipoles of said common space in a direction determined by the intensity of the magnetic field flowing in said control core and thus to control the permeability of each phase core to the corresponding alternative field.

5. A variable inductor according to claim 4, characterized in that said control core has an oval configuration and is of a cross section identical to that of each of said phase cores.

6. A variable inductor according to claim 4, characterized in that said control core has an hexagonal configuration and is of a cross section identical to that of each phase core.

7. A variable inductor according to claim 4, 5 or 6 characterized in that said phase cores comprise each a first winding and a second winding, the first windings being interconnected following a star-connection with a floating neutral and the second windings being interconnected following a delta-connection.

8. A variable inductor according to claim 4, 5 or 6 characterized in that said control core comprises a first winding connected to a circuit for coupling said direct current magnetic field to said phases of the alternative source.

9. A variable inductor according to claim 8, wherein said control core comprises a second winding connected to a constant and adjustable direct current source so as to induce in the control core a direct current magnetic field inverse to the magnetic field induced by said first winding.

10. A variable inductor according to claim 4, characterized in that said phase cores are symmetrically mounted around said control core.

11. A variable inductor according to claim 4, characterized in that said phase cores and said control core are made up of ferrite or laminated iron.

12. A variable permeability inductor, comprising a first and a second magnetic core forming together a closed magnetic circuit, the first and the second cores including three legs symmetrically disposed around each core and mounted in regis per pairs, in each of which circulates an alternative magnetic field proportional to one phase of a three-phase source; a ferromagnetic control core wherein circulates a direct current magnetic field and which is so disposed with respect to said first and second cores as to define a common magnetic space in which the magnetic field of each phase and the direct magnetic field are orthogonally superimposed to orient the magnetic dipoles of each common space in a predetermined direction and thus to control the permeability of the magnetic circuit to the alternative field of each phase.

13. A variable inductor according to claim 12, characterized in that said first and second phase cores and said control core have a cylindrical configuration and are of identical cross sections.

14. A variable inductor according to claim 12, characterized in that each pair of legs mounted in registry comprises a first winding and a second winding and in that the first windings are star-connected with a floating neutral whereas the second windings are delta-connected.

15. A variable inductor according to claim 12 or 14, characterized in that said control circuit comprises a winding through which flows a current having an intensity controlled by the current of the three-phase source by means of a rectifying bridge so as to define a self-control operation of said variable inductor.

16. A variable inductor according to claim 15, wherein a second winding is provided on the control core and connected to a direct current source so as to define an inverse control of said variable inductor by setting in opposition a direct current magnetic field inverse to that generated by said first winding.

17. A variable inductor according to claim 12, wherein a bank of capacitors is connected in parallel with said variable inductor to operate as a static compensator having a variable inductive and capacitive range.

18. A variable inductor according to claim 12, wherein a battery of capacitors is connected in series with said inductor.

19. A three-phase variable inductor to be connected to a three-phase alternative current source, including three variable inductors each comprising first closed magnetic circuit, formed of an anisotropic material through which flows an alternative magnetic field; a second closed magnetic circuit, also formed of an anisotropic material, through which circulates an adjustable direct current magnetic field; said first and second magnetic circuits being mounted with respect to one another so as to define at least two common magnetic spaces in which the respective alternative and direct magnetic fields are orthogonally superimposed to orient the magnetic dipoles in said common spaces following a direction predetermined by the intensity of said direct current magnetic field of the second circuit and thus to control the permeability of said second magnetic circuit to said alternative field, said three-phase variable inductor being characterized in that said variable inductors are interconnected according to a star-connection with a floating neutral so as to determine in each inductor an alternative magnetic field corresponding to one phase of said three-phase source and that the second coils are interconnected through a triangle connection.

20. A three-phase variable inductor to be connected to a three-phase alternative current source, including three variable inductors each comprising a first closed magnetic circuit, formed of an anisotropic material through which flows an alternative magnetic field; a second closed magnetic circuit, also formed of an anisotropic material, through which circulates an adjustable direct current magnetic field; said first and second magnetic circuits being mounted with respect to one another so as to define at least two common magnetic spaces in which the respective alternative and direct magnetic fields are orthogonally superimposed to orient the magnetic dipoles in said common spaces following a direction predetermined by the intensity of said direct current magnetic field of the second circuit and thus to control the permeability of said second magnetic circuit to said alternative field, a first and a second coil being wound around the anisotropic material of said first magnetic circuit, a coil being wound around the anisotropic core of said second magnetic circuit and connected to a control circuit governing the intensity of the direct current magnetic field, said control circuit comprising a rectifying bridge interconnecting said second coil to said coil inducing said direct current magnetic field to accomplish a self-control of said variable inductor, said three-phase variable inductor being characterized in that said variable inductors are interconnected according to a star-connection with a floating neutral so as to determine in each inductor an alternative magnetic field corresponding to one phase of said three-phase source and that the second coils are interconnected through a triangle connection.

* * * * *